US009297344B2

(12) United States Patent
Gerber et al.

(10) Patent No.: US 9,297,344 B2
(45) Date of Patent: Mar. 29, 2016

(54) FUEL INJECTION VALVE FOR AN INTERNAL COMBUSTION ENGINE

(75) Inventors: Wolfgang Gerber, Wenzenbach (DE); Thomas Hofmann, Obertraubling (DE); Uwe Leuteritz, Regensburg (DE)

(73) Assignee: CONTINENTAL AUTOMOTIVE GMBH, Hannover (DE)

( * ) Notice: Subject to any disclaimer, the term of this patent is extended or adjusted under 35 U.S.C. 154(b) by 901 days.

(21) Appl. No.: 13/497,366

(22) PCT Filed: Sep. 16, 2010

(86) PCT No.: PCT/EP2010/063640

§ 371 (c)(1),
(2), (4) Date: Mar. 21, 2012

(87) PCT Pub. No.: WO2011/033036

PCT Pub. Date: Mar. 24, 2011

(65) Prior Publication Data

US 2012/0180757 A1 Jul. 19, 2012

(30) Foreign Application Priority Data

Sep. 21, 2009 (DE) ..... 10 2009 042 155

(51) Int. Cl.
*F02M 61/18* (2006.01)

(52) U.S. Cl.
CPC ..... *F02M 61/1866* (2013.01); *F02M 61/1873* (2013.01); *F02M 61/1886* (2013.01); *F02M 61/1893* (2013.01); *F02M 2200/06* (2013.01)

(58) Field of Classification Search
CPC ..... F02M 61/1866; F02M 61/1873; F02M 61/1886; F02M 61/1893; F02M 2200/06
USPC ..... 123/294, 298, 308, 467; 239/533.2, 239/533.3, 533.7, 596
See application file for complete search history.

(56) References Cited

U.S. PATENT DOCUMENTS 6,427,932 B1 * 8/2002 Danckert ..... F02M 61/18 123/467
6,892,965 B2 * 5/2005 Haeberer ..... F02M 61/047 239/533.12

(Continued)

FOREIGN PATENT DOCUMENTS

DE 3303470 A1 8/1984 ..... F02M 61/18
DE 10163909 A1 7/2003 ..... F02M 61/06

(Continued)

OTHER PUBLICATIONS

International PCT Search Report and Written Opinion, PCT/EP2010/063640, 13 pages.

*Primary Examiner* — Mahmoud Gimie
(74) *Attorney, Agent, or Firm* — Slayden Grubert Beard PLLC

(57) ABSTRACT

A fuel injection valve for an internal combustion engine may include an injector body having a receiving hole for an injector needle. The receiving hole may be implemented as a blind hole and may form an injector ring chamber in the injector shaft and a cone-shaped valve seat at the base thereof, and a blind injector hole at the tip of the valve seat cone, from which at least one injector hole extends. The injector needle may include an at least partially cone-shaped needle tip and may seal off the blind injector hole, and thus the at least one injector hole, from the injector ring chamber. The needle tip may include a needle pilot adapted in contour and extent to the blind injector hole in the valve seat, the pilot protruding into the blind injector hole and thus reducing a compression volume formed between the valve seat and injector hole.

18 Claims, 5 Drawing Sheets

(56) References Cited

U.S. PATENT DOCUMENTS

| | | | | |
|---|---|---|---|---|
| 6,918,549 | B2 * | 7/2005 | Theodorof | 239/533.3 |
| 7,188,790 | B2 * | 3/2007 | Astachow et al. | 239/585.1 |
| 7,578,450 | B2 * | 8/2009 | Stockner et al. | 239/1 |
| 2002/0179743 | A1 * | 12/2002 | Haeberer et al. | 239/533.12 |
| 2003/0057299 | A1 * | 3/2003 | Itoh | F02M 61/18 239/533.3 |
| 2003/0173428 | A1 * | 9/2003 | Buehler | 239/533.2 |
| 2004/0056118 | A1 * | 3/2004 | Mattes et al. | 239/533.12 |
| 2006/0011749 | A1 * | 1/2006 | Kuegler et al. | 239/533.12 |
| 2007/0057094 | A1 * | 3/2007 | Stockner et al. | 239/569 |
| 2007/0108317 | A1 * | 5/2007 | Boecking | 239/533.12 |
| 2008/0142622 | A1 * | 6/2008 | Gray | 239/556 |
| 2011/0180634 | A1 | 7/2011 | Sander et al. | 239/533.2 |

FOREIGN PATENT DOCUMENTS

| | | | | |
|---|---|---|---|---|
| DE | 10306700 | A1 | 8/2004 | F02M 61/18 |
| DE | 102006033687 | A1 | 1/2008 | F02M 61/18 |
| DE | 102008039920 | A1 | 3/2010 | F02M 61/18 |
| GB | 2198785 | A * | 6/1988 | |
| WO | 2004/031570 | A1 | 4/2004 | F02M 61/18 |

* cited by examiner

FUEL INJECTION VALVE FOR AN INTERNAL COMBUSTION ENGINE

CROSS-REFERENCE TO RELATED APPLICATIONS

This application is a U.S. National Stage Application of International Application No. PCT/EP2010/063640 filed Sep. 16, 2010, which designates the United States of America, and claims priority to German Application No. 10 2009 042 155.6 filed Sep. 21, 2009, the contents of which are hereby incorporated by reference in their entirety.

TECHNICAL FIELD

This disclosure relates to fuel injection valves for an internal combustion engine. A fuel injection valve as disclosed herein may be used to inject fuel, gasoline or diesel, at a targeted time and quantity, directly into the combustion chamber of a cylinder of a running internal combustion engine. Injection valves of this type may be manufactured and used on a large scale for combustion engines, e.g., for the automobile industry.

BACKGROUND

Developers and manufacturers particularly in this technical application area are confronted by ever increasing requirements regarding the level of performance and pollutant emissions of running combustion engines. This also results in ever increasing demands being placed on the precision, quality and operating mode of the individual components in injection technology, and in this case especially on the fuel injector valves, over the entire life span, e.g., of a vehicle.

Many fuel injection valves currently available are highly complex, electro-mechanical devices which place the most stringent demands on material and production technology. A fuel injection valve of this type may fundamentally comprise the injector body that has an injector shaft with an injector ring chamber, injector needle, closing spring, valve seat and injector holes, as well as an actuating device with an actuator arrangement and transmission mechanics or control hydraulics with a control valve for actuating the injector needle. Electro-magnetic actuating drives or also piezoelectric actuators can be used here as actuators. The injector needle is urged in the idle phase by the closing spring into the valve seat and seals off the injector ring chamber, which is filled with fuel and highly pressurized, from the injector holes.

For the purpose of injecting fuel into the combustion chamber of the internal combustion engine, the injector needle is raised off the valve seat, thus revealing the injector holes, by actuating the actuator and by means of transmission mechanics or control hydraulics. The high pressure fuel is injected through the injector holes directly into the associated combustion chamber. A fuel injection valve of this type is known for example from DE 33 03 470 A1.

DE 33 03 470 A1 discloses an injection nozzle for combustion engines with a pressure chamber in a valve body and an injector needle. The injector needle comprises a sealing cone that lies in a cone-shaped seat of the valve body and seals off the injector holes from the pressure chamber. The cone-shaped seat of the valve body transforms into a blind cut-out described as a well, from which the injector holes extend.

The performance and emission behavior of the internal combustion engine may greatly depend upon the accuracy of the individual fuel injections and upon the geometric conditions in the injector shaft.

The accuracy of the injection quantities may greatly depend upon the available pressure and its constancy in the injector ring chamber and also upon the precision of the activation and the tolerances of the mechanics and in this case in particular of the injector holes. It is a known effect that, as the power density rises and the exhaust gas return rate increases, a greater number of deposits are formed in the injector holes as a result of coking and this has a negative influence on the required accuracy of the fuel injection and thus on the performance and emission behavior.

It is also known that the dead volume, which is referred to below as the compression volume, that is dictated by the construction and formed between the valve seat and the injector hole outlet as a result of the structural design and that is filled with fuel has a negative influence, in particular on the hydrocarbon emissions (HC emissions) of the internal combustion engine. An increase in the compression volume causes higher HC-emissions, as a result of the fuel vaporizing from the injector holes into the combustion chamber following the injection of fuel.

SUMMARY

A fuel injection valve for an internal combustion engine may include an injector body, at least one injector hole, and an injector needle. The injector body may have an injector shaft and a receiving hole for an injector needle, wherein the receiving hole is implemented as a blind hole that forms an injector ring chamber in the injector shaft and that comprises at its base a cone-shaped valve seat and in the region of the cone-shaped tip of the valve seat a blind injector hole. The at least one injector hole may extend from this blind injector hole and connecting the injector ring chamber below the valve seat to the outer region. The injector needle may have a needle tip formed at least partially in the shape of a cone, wherein the injector needle is disposed displaceably in the longitudinal direction in the receiving hole and when the fuel injection valve is in the closed state the said injector needle lies with the needle tip in the valve seat such that it seals off the blind injector hole and consequently the at least one injector hole from the injector ring chamber. The needle tip may comprise a needle pilot that is adapted in contour and extent to the blind injector hole and protrudes into the blind injector hole of the valve seat and thereby reduces a compression volume formed between the valve seat and the injector hole.

In a further embodiment, the blind injector hole comprising the valve seat is implemented at least partially in the shape of a cone and comprises a smaller angle of taper than the valve seat. In a further embodiment, the cross-section area of the annular gap formed between the blind injector hole of the valve seat and the needle pilot of the needle tip is widened in places by virtue of at least one partial depression on the needle pilot periphery and/or in the blind injector hole periphery. In a further embodiment, when the fuel injection valve is in the closed state the at least one partial depression is disposed at the height of the at least one injector hole or, as seen from the dome-shaped tip, over the said injector hole. In a further embodiment, the at least one partial depression is implemented as an annular groove over the periphery. In a further embodiment, the at least one partial depression is implemented as a punctiform depression. In a further embodiment, when the fuel injection valve is in the open state the cross-section area of the annular gap formed between the blind injector hole and the needle pilot is smaller than the outlet cross-section area of the at least one injector hole or the sum of the outlet cross-section areas of all injector holes that extend from the blind injector hole of the valve seat.

BRIEF DESCRIPTION OF THE DRAWINGS

Example embodiments will be explained in more detail below with reference to figures, in which.

DETAILED DESCRIPTION

Figure 1:
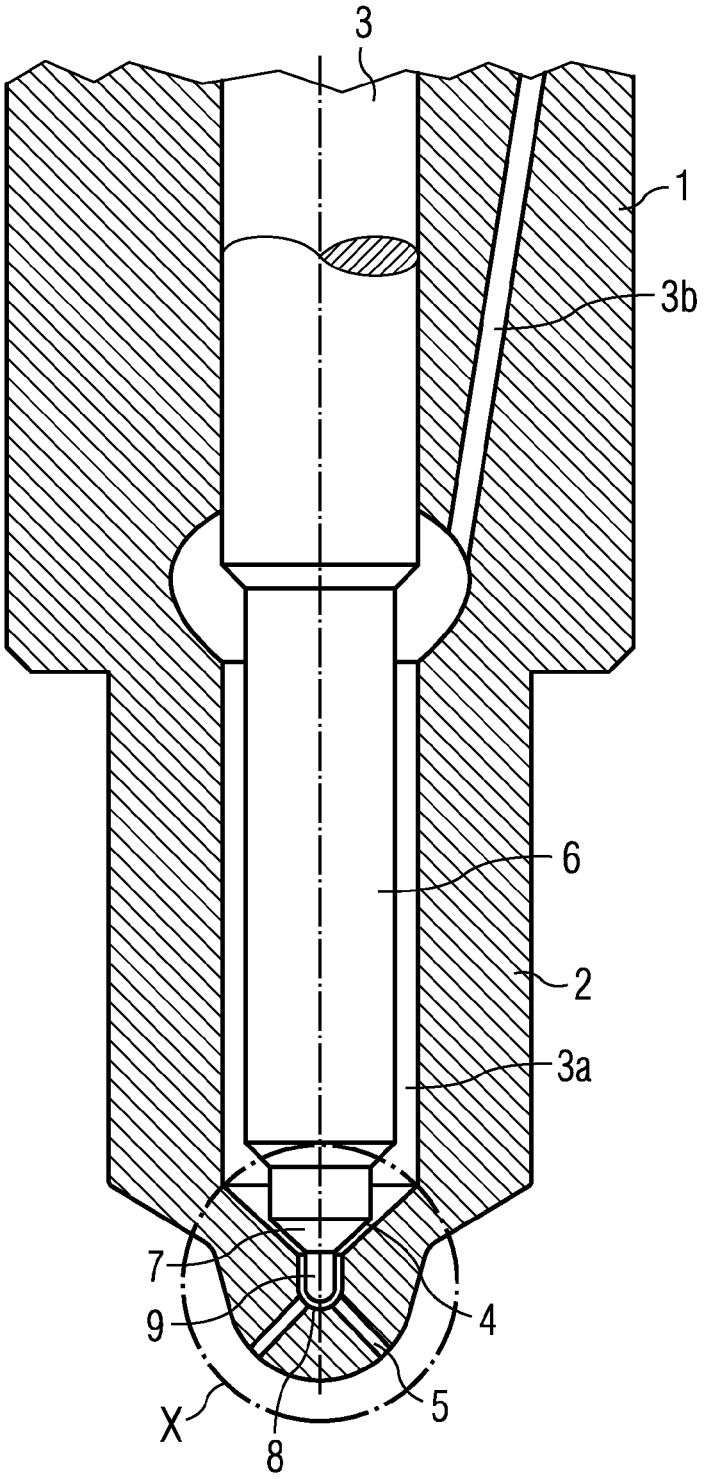
FIG. 1 shows a cross-sectional view of the injector shaft region of an example fuel injection valve, according to an example embodiment.

Some embodiments provide a fuel injection valve that may ensure the performance and emission behavior of the internal combustion engine are permanently or substantially permanently improved and constant.

In some embodiments, a fuel injection valve for an internal combustion engine comprises an injector body that has an injector shaft and a receiving hole for an injector needle, wherein the receiving hole is implemented as a blind hole. The receiving hole forms a needle guide in the upper region and forms an injector ring chamber in the region of the injector shaft; said receiving hole forms a cone-shaped valve seat at its base and also a blind cut-out, referred to below as a blind injector hole, in the region of the cone-shaped tip of the valve seat. At least one injector hole may extend from this cut-out and connects the injector ring chamber below the valve seat to the outer region, i.e. to the respective combustion chamber of the internal combustion engine. The injector needle that is disposed displaceably in the longitudinal direction in the receiving hole may have an at least partially cone-shaped needle tip and, when the fuel injection valve is in the closed state, it lies with the needle tip in the valve seat such that it seals off the blind injector hole and consequently the at least one injector hole from the injector ring chamber. The needle tip of the injector needle may have a protruding shape, referred to below as a needle pilot, that is adapted in contour and extent to the blind injector hole and said shape protrudes into the blind injector hole, thus reducing a compression volume formed between the valve seat and the injector hole.

By reducing the compression volume, it may be possible to reduce the HC emissions. Also, the flow cross section upstream of the at least one injector hole may be reduced such that a cavitating fuel flow into the injector holes may increase which may counteract the deposits in the injector holes. A constantly high level of performance of the internal combustion engine may be achieved in this manner.

In one advantageous embodiment, the blind injector hole is implemented at least partially in the shape of a cone and comprises a smaller angle of taper than the valve seat itself. This may simplify the manufacturing process and makes it possible to coordinate the measurements of the inner contour of the blind injector hole and the outer contour of the needle pilot of the needle tip of the injector needle. Furthermore, this design may render it possible for the flow cross-section that is formed between the inner contour of the blind injector hole and the outer contour of the needle pilot through the annular gap to increase in size with increasing needle stroke of the injector needle, and may thus offer an additional opportunity of influencing the metering of the fuel by varying the through-flow quantity.

In a further advantageous embodiment the cross-section area of the annular gap formed between the blind injector hole of the valve seat and the needle pilot of the needle tip is widened in places by virtue of at least one partial depression in the needle pilot wall, in the blind injector hole wall or in both. This may cause an additional whirling of the fuel flowing in the annular gap between the needle pilot and the blind injector hole and may enhance the self-cleaning effect of the fuel flow in the annular gap and the injector holes.

In some embodiments the abovementioned partial depressions are disposed at the height of the at least one injector hole or, as seen from the dome-shaped tip, over the said injector hole. As far as the needle pilot is concerned, this is seen when the valve is in the closed state. As a consequence, the annular gap between the blind injector hole and needle pilot is widened in places between the valve seat and the injector holes in the flow direction of the fuel, which may enhance the cavitation of the fuel flow upstream of and in the injector holes and thus may enhance the self-cleaning effect.

The partial cut-outs in the blind injector hole wall and the needle pilot wall may be implemented as an annular groove over the periphery. This may allow for a simple manufacturing process.

Alternatively, the partial depressions in the blind injector hole wall and the needle pilot wall can be formed as punctiform depressions or depressions in the form of craters, recesses or spherical segments. Other possible shapes for the depressions that are possibly directly associated with the respective manufacturing process are also included here.

Furthermore, combinations of the aforementioned depressions in the blind injector hole wall and needle pilot wall can naturally also be implemented in different shapes and arrangements.

In a further embodiment, when the fuel injection valve is in the open state, the cross-section area of the annular gap formed between the inner contour of the blind injector hole of the valve seat and the outer contour of the needle pilot of the needle tip is smaller than the outlet cross-section area of the at least one injector hole or possibly the sum of the outlet cross-section areas of all injector holes that extend from the blind injector hole of the valve seat. This structural measure may enhance the effect of the cavitating fuel flow and thus improves the "self-cleaning" behavior in the injector holes.

FIG. 1 shows the injector shaft region of an example fuel injector valve according to an example embodiment. The illustration shows the injector body 1 and the injector needle 6. The other components of a fuel injection valve, such as the actuating device with the actuator arrangement and transmission mechanics or control hydraulics with a control valve for actuating the injector needle are not illustrated here. The injector body 1 comprises a receiving hole 3 in the form of a blind hole for the injector needle 6. A cone-shaped valve seat 4 is implemented at the lower end, i.e. at the base of the blind receiving hole 3 of the injector body 1.

The injector needle 6 comprises a multi-stepped diameter. In the upper region, the outer diameter of the injector needle corresponds approximately to the inner diameter of the receiving hole 3 of the injector body 1, such that the injector needle 6 is guided in a gliding manner in the receiving hole 3, yet at the same time ensuring that the injector needle 6 sits as closely as possible in the receiving hole 3. In the lower region, the injector needle 6 has a reduced outer diameter in comparison to the inner diameter of the receiving hole 3, so that an injector ring chamber 3*a* is formed between the injector needle 6 and the injector body 1 in the region of the injector shaft 2. The injector ring chamber 3*a* widens in the form of an annular groove in its upper region and is connected via a fuel inlet bore 3*b* to a high pressure fuel storage device (not shown) of the injection system. The injector ring chamber 3*a* is filled with fuel via the fuel inlet bore 3*b* and pressurized with the operating pressure of the high pressure fuel storage device.

Figure 2:
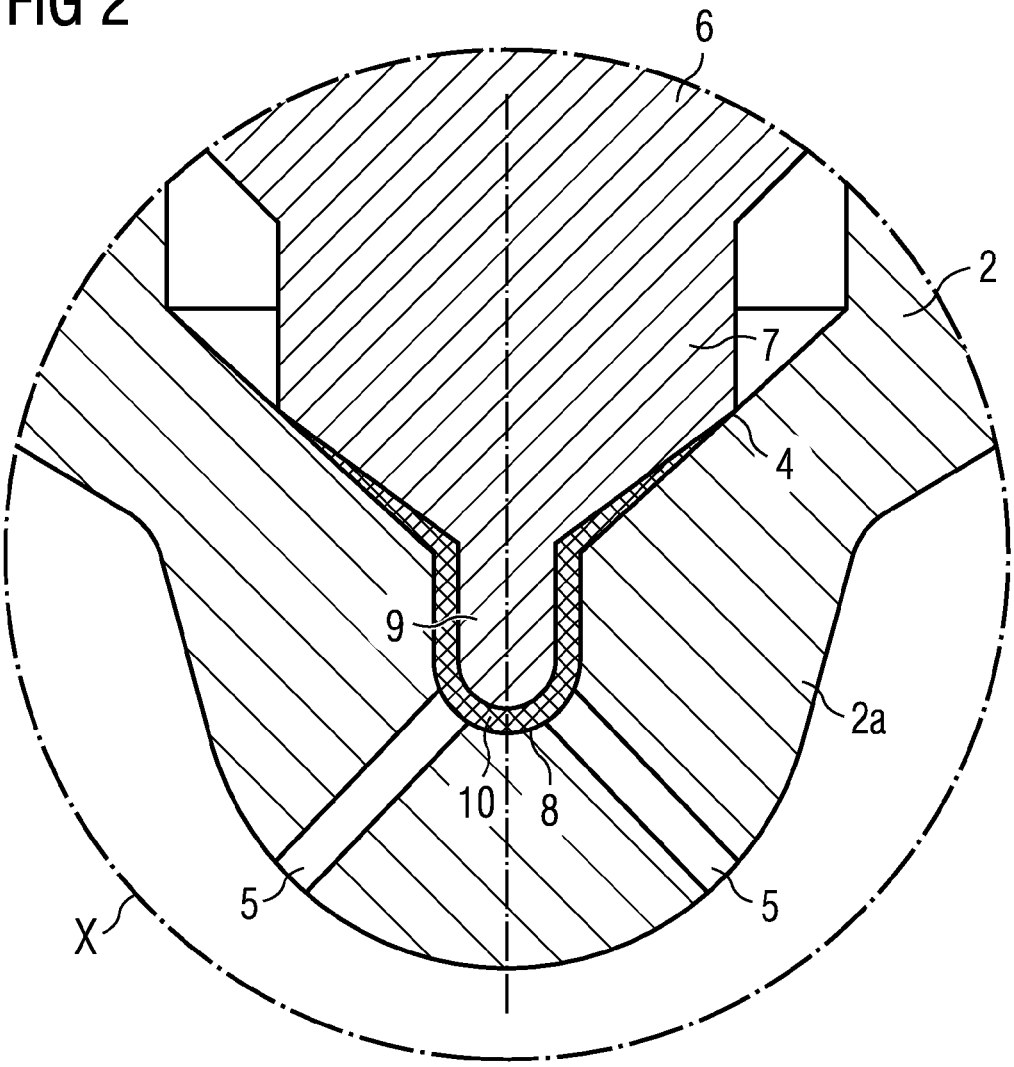
FIG. 2 shows an enlarged cross-sectional view of the region of the valve seat designated in FIG. 1 by X and the needle tip of the injector needle, according to an example embodiment.

The injector needle 6 has at its lower end a further step and a cone-shaped needle tip 7. This region, designated in FIG. 1 by X, of the needle tip 7 and of the valve seat 4 is illustrated in FIG. 2 as an enlarged sectional view. It is evident that the angle of taper of the needle tip 7 is slightly greater here than the angle of taper of the valve seat 4. As a consequence, the needle tip 7 and the valve seat 4 only contact each other in the form of a line and as a result the surface pressure is increased and the injector ring chamber 3*a* tightly sealed in this region.

The cone-shaped valve seat 4 in the injector shaft 2 of the injector body 1 widens at its tip with a cut-out in the form of a blind hole, also described here as a blind injector hole 8. The injector shaft 2 around this blind injector hole 8 is in the form of a dome-shaped tip 2*a*. Holes, i.e. the injector holes 5, that extend through the wall of the dome-shaped tip 2*a* are located in the region of the dome-shaped tip 2*a* and create a connection between the blind injector hole 8 and the outer chamber of the injector shaft 2, i.e. in the installed state a combustion chamber of the internal combustion engine. If the valve is in the open state, i.e. the injector needle 6 is raised off the valve seat 4, the high pressure prevailing in the injector ring chamber causes fuel to be injected through the injector holes 5 into a combustion chamber of the internal combustion engine.

A chamber that is sealed off from the injector ring chamber 3*a* by the seal seat of the injector needle 6 when the fuel injection valve is in the closed state is created between the needle tip 7 and the valve seat 4 and the blind injector hole 8 as far as the outlet orifice of the injector holes 5. This chamber remains filled with fuel as the valve is closed following a fuel injection procedure. The volume of fuel enclosed in this way is also described here as the compression volume 10.

The injector needle 6 comprises on its needle tip 7 a cone-shaped protrusion that is also described here as a needle pilot 9. The outer contour and extent of the needle pilot 9 are formed such that it protrudes into the blind injector hole 8 on the inner side of the dome-shaped tip 2*a* when the fuel injection valve is in the closed state. This reduces considerably the compression volume between the needle tip 7 and the injector blind hole 8. The dimensions of the needle pilot 9 and blind injector hole 8 are coordinated such that it is guaranteed that an annular gap between the needle pilot 9 and blind injector hole 8 is sufficiently large for the required through-flow of fuel during the fuel injection procedure, i.e., when the fuel injection valve is in the open state. On the other hand, the cross-section area of the annular gap is dimensioned such that, when the fuel injection valve is in the open state, the said cross-section is smaller than the sum of the outlet cross-section areas of all the injector holes 5 which extend from the blind injector hole 8 of the valve seat 4. This results in the formation of a cavitating fuel flow that may be suitable for obviating deposits in the annular gap and the injector holes or even for removing already existing deposits.

FIG. 2 shows a combination of a needle pilot 9 and a blind injector hole 8 with a substantially cylindrical contour and spherical end, as a result of which the cross-section area of the annular gap does not change during small opening strokes of the injector needle 6 and thus the same flow conditions always prevail in the blind injector hole 8 and injector holes 5. The through-flow cross-section area upstream of the injector holes 5 increases and the through-flow rate and thereby the quantity of fuel being injected increase only when the injector needle strokes are considerably greater, as soon as the needle pilot 9 is drawn back almost completely out of the blind injector hole 8.

Figure 3:
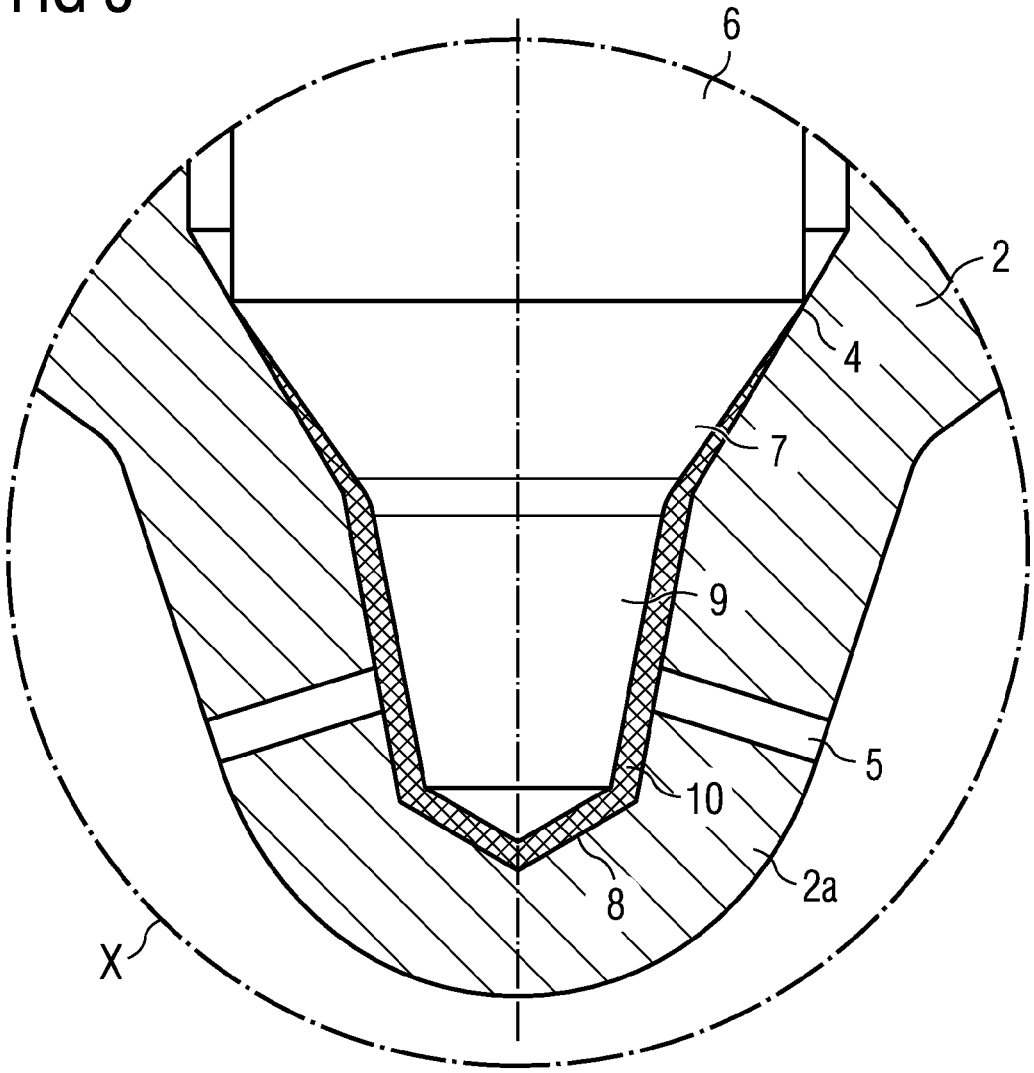
FIG. 3 shows a further cross-sectional view of the region designated in FIG. 1 by X with a cone-shaped design of the needle pilot, according to an example embodiment.

An alternative embodiment of the needle pilot 9 and blind injector hole 8 is illustrated in FIG. 3. This embodiment comprises a substantially cone-shaped contour that is in the form of a truncated cone or extends in a tapered manner. FIG. 3 initially shows a truncated cone-shaped or tapered contour of the blind injector hole 8 and of the needle pilot 9, the said contour extending from the valve seat 4 in the direction of the needle pilot end. The truncated cone is then adjoined by a cone, in which the needle pilot and blind injector hole terminate. The dimensions of the needle pilot 9 and blind injector hole 8 are in turn coordinated such that an annular gap remains between the two of them, even when the fuel injection valve is in the closed state (as illustrated). In this embodiment, however, the annular gap increases when the needle stroke becomes greater as the valve is opened. It may be possible in this case, by correspondingly adjusting or controlling the stroke of the injector needle, as required, to increase the through-flow rate and in so doing to reduce the cavitation formation in the flow or to increase said formation whilst simultaneously reducing the through-flow rate. As a consequence, the number of options for influencing the fuel injection procedure may be increased.

Figure 4:
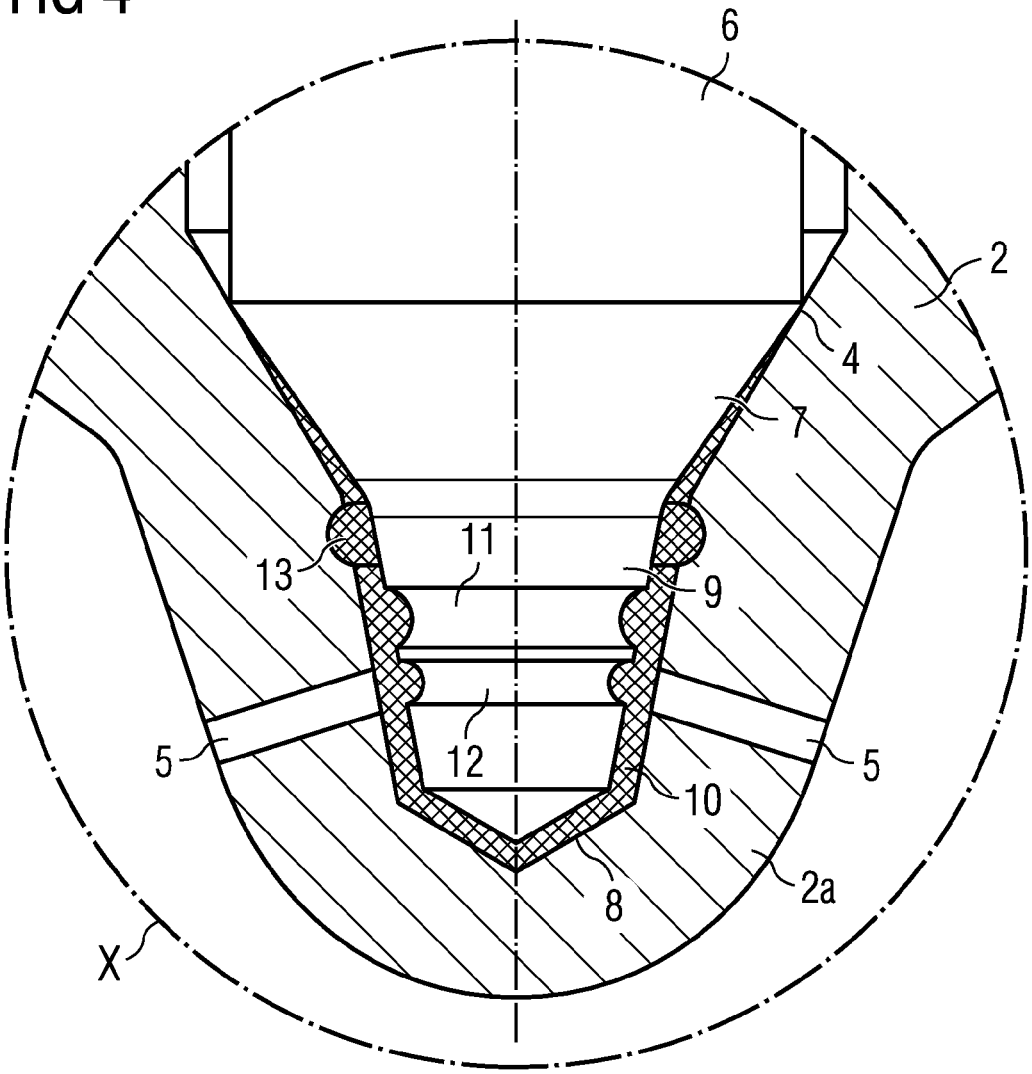
FIG. 4 shows a further cross-sectional view of the region designated in FIG. 1 by X with a cone-shaped design of the needle pilot and additional annular grooves on the needle pilot periphery and on the periphery of the blind injector hole, according to an example embodiment.

FIG. 4 shows as in FIG. 3 a needle pilot 9 and a blind injector hole 8 with a truncated cone-shaped contour. In this case, however, the truncated cone-shaped contour of the needle pilot has also been provided on the periphery with two needle pilot-annular grooves 11 and 12. The needle pilot-annular groove 12, the lower groove in the figure, is located on the truncated cone of the needle pilot 9 approximately at a height such that, when the fuel injection valve is in the closed state, the said groove is disposed directly opposite the inlet orifice of the two illustrated injector holes 5. The second, upper needle pilot-annular groove 11 is located at a short distance above the first needle pilot annular groove 12. The annular grooves cause an additional whirling of the fuel flow in the annular gap between the needle pilot 9 and the blind injector hole 8, as a consequence of which the inclination of the fuel flow to cavitate is increased and thus the cleaning effect in the annular gap and the injector holes 5 is enhanced. FIG. 4 shows a needle pilot 9 with two annular grooves 11, 12, but embodiments with only one annular groove or with more than two annular grooves are also possible. Furthermore, a blind injector hole-annular groove 15 extending between the injector holes 5 and the valve seat 4 over the periphery of the blind injector hole 8 is disposed on the periphery of the blind injector hole wall.

Figure 5:
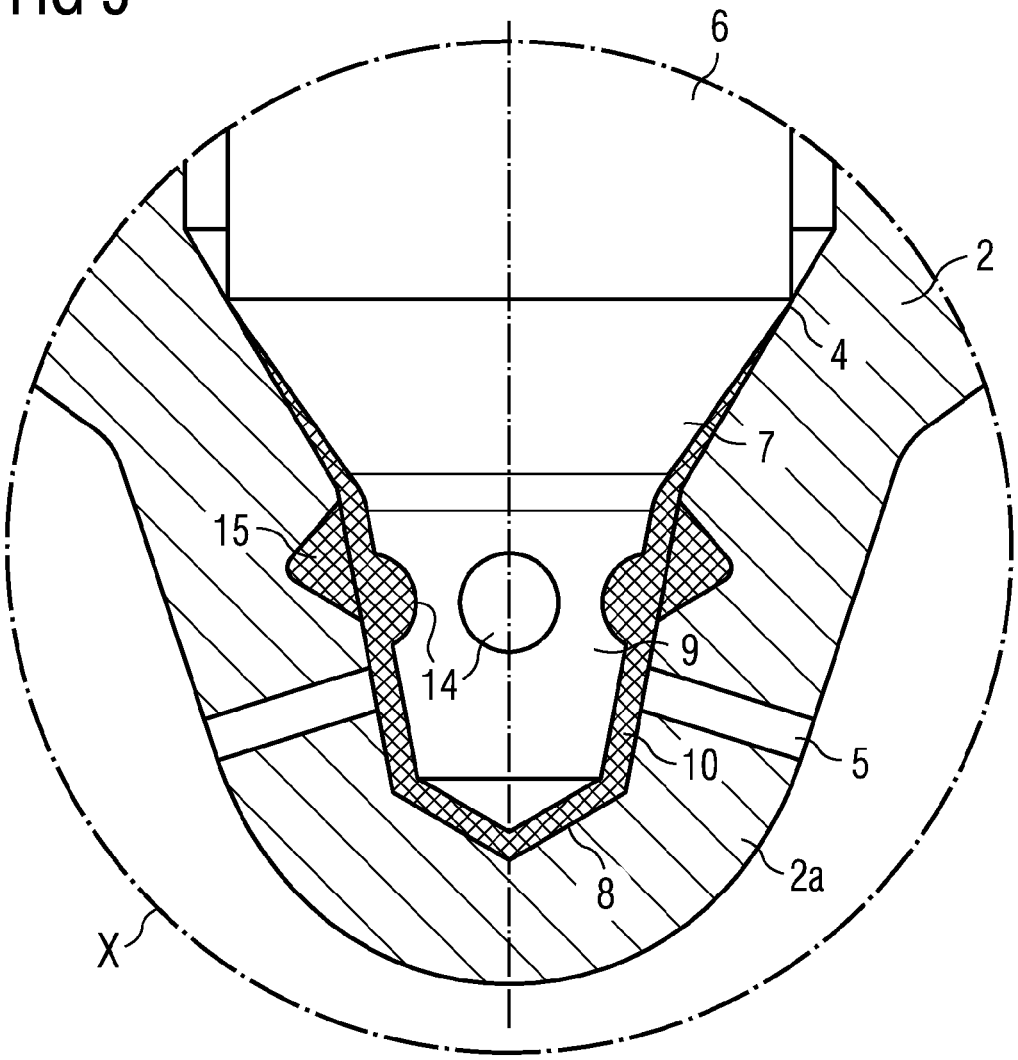
FIG. 5 shows a further cross-sectional view of the region designated in FIG. 1 by X with a cone-shaped design of the needle pilot and additional punctiform depressions on the needle pilot periphery and the blind injector hole periphery, according to an example embodiment.

FIG. 5 shows as in FIG. 3 a needle pilot 9 and a blind injector hole 8 with a truncated-cone contour, but in this case a plurality of punctiform depressions 14, 15 are disposed both on the truncated cone-shaped contour of the needle pilot and on the inner wall of the blind injector hole on the periphery. The needle pilot depressions 14 are implemented here by way of example as depressions in the form of spherical segments, the blind injector hole depressions 15 are illustrated as crater-shaped depressions. These two embodiments of the depressions are shown here as representatives for further possible forms of depressions that can ensue possibly as a result of different manufacturing processes.

The embodiments shown in the figures may substantially reduce the compression volume 10 in comparison to a valve arrangement without a needle pilot and may thereby contribute to the reduction of emissions of unburnt hydrocarbons, HC emissions, during the operation of the internal combustion engine.

What is claimed is:

1. A fuel injection valve for an internal combustion engine, comprising:

an injector body having an injector shaft and a receiving hole for an injector needle, wherein the receiving hole defines:

an injector ring chamber in the injector shaft, a cone-shaped valve seat at one end, and a blind injector hole formed by a wall extending from a tip region of the cone-shaped valve seat, wherein the blind injector hole has a smaller angle of taper than the cone-shaped valve seat, with respect to a longitudinal axis of the receiving hole, at least one injector tip hole formed in a tip portion of the injector shaft, the at least one injector tip hole extending from the blind injector hole and connecting the injector ring chamber below the valve seat to an outer region, and an injector needle being movable in a longitudinal direction in the receiving hole and having a needle tip comprising:

a cone-shaped needle portion extending downstream from an elongated needle body, and a needle pilot extending downstream from the cone-shaped needle portion, wherein the needle pilot has a smaller angle of taper than the cone-shaped needle portion, with respect to the longitudinal axis of the receiving hole, wherein the cone-shaped valve seat has an angle of taper that is smaller than the angle of taper of the cone-shaped needle portion of the injector needle, such that in a closed state of the fuel injection valve the cone-shaped needle portion of the needle tip rests on the cone-shaped valve seat only at a circumferential line of transition between the cone-shaped needle portion and the elongated needle body, thereby defining a contiguous chamber between the cone-shaped needle portion and the cone-shaped valve seat and between the needle pilot and the blind injector hole wall, the contiguous chamber being sealed off from the injector ring chamber in the closed state of the fuel injection valve, and wherein the needle pilot of the needle tip has a needle pilot tip having a cross-sectional shape with respect to the longitudinal axis corresponding to the cross-sectional shape of the blind injector hole with respect to the longitudinal axis to protrude into the blind injector hole reducing a compression volume formed between the valve seat and the at least one injector tip hole extending from the blind injector hole in the closed state of the fuel injection valve.

2. The fuel injection valve of claim 1, wherein the blind injector hole of the valve seat defines a cone-shaped portion.

3. The fuel injection valve of claim 1, wherein a cross-section area of an annular gap formed between the blind injector hole of the valve seat and the needle pilot of the needle tip is widened in at least one location by at least one partial depression formed in a periphery of the needle pilot or in a periphery of the blind injector hole.

4. The fuel injection valve of claim 3, wherein in the closed state of the fuel injection valve a particular partial depression is located directly across from an inlet end of each injector tip hole.

5. The fuel injection valve of claim 3, wherein the at least one partial depression comprises an annular groove.

6. The fuel injection valve of claim 3, wherein the at least one partial depression comprises a punctiform depression.

7. The fuel injection valve of claim 1, wherein in an open state of the fuel injection valve a cross-sectional area of an annular gap formed between the blind injector hole and the needle pilot is smaller than the sum of cross-sectional areas of outlet ends of all injector tip holes that extend from the blind injector hole of the valve seat.

8. The fuel injection valve of claim 3, wherein in the closed state of the fuel injection valve a particular partial depression is located upstream from an inlet end of each injector tip hole.

9. The fuel injection valve of claim 1, comprising at least two annular depressions formed in the needle pilot.

10. The fuel injection valve of claim 9, wherein at least one of the annular depressions is aligned with inlet ends of the at least one injector tip hole.

11. The fuel injection valve of claim 1, comprising at least two non-annular depressions formed in the needle pilot.

12. The fuel injection valve of claim 1, wherein the angle of taper of the cone-shaped valve seat is smaller than the angle of taper of the cone-shaped needle portion of the injector needle but larger than the angle of taper of the needle pilot.

13. A fuel injection valve for an internal combustion engine, comprising:

an injector body defining an injector shaft and a receiving hole for an injector needle, wherein the receiving hole defines:

a cone-shaped valve seat, and a blind injector hole formed by a wall extending from the cone-shaped valve seat, wherein the blind injector hole has a smaller angle of taper than the cone-shaped valve seat, with respect to a longitudinal axis of the receiving hole, at least one injector tip hole formed in a tip portion of the injector shaft, each injector tip hole extending from the blind injector hole that extends from the cone-shaped valve seat, and an injector needle being axially movable within the receiving hole, the injector needle comprising:

a cone-shaped needle portion, and a needle pilot having a needle pilot tip, the needle pilot extending from the cone-shaped needle portion, wherein the needle pilot has a smaller angle of taper than the cone-shaped needle portion with respect to the longitudinal axis of the receiving hole, wherein in a closed state of the fuel injection valve the cone-shaped needle portion of the injector needle rests on the cone-shaped valve seat with the needle pilot protruding into the blind injector hole, and the needle pilot tip having a cross-sectional shape with respect to the longitudinal axis corresponding to the cross-sectional shape of the blind injector hole with respect to the longitudinal axis, wherein an annular gap formed between the blind injector hole and the needle pilot when the fuel injection valve is in a closed state is wider in at least one location by at least one depression formed in the blind injector hole wall.

14. The fuel injection valve of claim 13, wherein the at least one depression formed in the blind injector hole wall comprises an annular groove.

15. The fuel injection valve of claim 13, wherein the at least one depression formed in the blind injector hole wall comprises at least two annular grooves.

16. The fuel injection valve of claim 13, wherein the at least one depression formed in the blind injector hole wall comprises at least one punctiform depression.

17. The fuel injection valve of claim 13, wherein in the closed state of the fuel injection valve a particular depression formed in the blind injector hole wall is located upstream from an inlet end of each injector tip hole.

18. An internal combustion engine, comprising:

at least one cylinder, and at least one injection valve corresponding to the at least one cylinder, each injection valve comprising:

an injector body defining an injector shaft and a receiving hole for an injector needle, wherein the receiving hole defines:

a cone-shaped valve seat, and a blind injector hole extending from the cone-shaped valve seat, wherein the blind injector hole has a smaller angle of taper than the cone-shaped valve seat, with respect to a longitudinal axis of the receiving hole, at least one injector tip hole formed in a tip portion of the injector shaft, each injector tip hole extending from the blind injector hole that extends from the cone-shaped valve seat, and an injector needle being axially movable within the receiving hole, the injector needle comprising:

a cone-shaped needle portion extending downstream from an elongated needle body, and a needle pilot extending downstream from the cone-shaped needle portion, wherein the needle pilot has a smaller angle of taper than the cone-shaped needle portion, with respect to the longitudinal axis of the receiving hole, wherein the cone-shaped valve seat has an angle of taper that is smaller than the angle of taper of the cone-shaped needle portion of the injector needle, such that in a closed state of the fuel injection valve the cone-shaped needle portion of the injector needle rests on the cone-shaped valve sea only at a circumferential line of transition between the cone-shaped needle portion and the elongated needle body, thereby defining a contiguous chamber between the cone-shaped needle portion and the cone-shaped valve seat and between the needle pilot and the blind injector hole such that the needle tip seals off the contiguous chamber and the at least one injector tip hole in the closed state of the fuel injection valve, and the needle pilot having a cross-sectional shape with respect to the longitudinal axis corresponding to the cross-sectional shape of the blind injector hole with respect to the longitudinal axis.

* * * * *